US010151314B2

(12) United States Patent
Neilson

(10) Patent No.: US 10,151,314 B2
(45) Date of Patent: Dec. 11, 2018

(54) GEAR-DRIVEN FLOW-THROUGH PITOT TUBE PUMP

(71) Applicant: Envirotech Pumpsystems, Inc., Salt Lake City, UT (US)

(72) Inventor: Bryce Neilson, Kaysville, UT (US)

(73) Assignee: Envirotech Pumpsystems, Inc., Salt Lake City, UT (US)

( * ) Notice: Subject to any disclaimer, the term of this patent is extended or adjusted under 35 U.S.C. 154(b) by 798 days.

(21) Appl. No.: 14/209,409

(22) Filed: Mar. 13, 2014

(65) Prior Publication Data

US 2014/0271127 A1 Sep. 18, 2014

Related U.S. Application Data

(60) Provisional application No. 61/798,539, filed on Mar. 15, 2013.

(51) Int. Cl.

| | |
|---|---|
| ***F04D 17/10*** | (2006.01) |
| ***F04D 29/42*** | (2006.01) |
| ***F04D 1/12*** | (2006.01) |

(52) U.S. Cl.

CPC ..... *F04D 1/12* (2013.01); *F04D 29/4293* (2013.01)

(58) Field of Classification Search

CPC ..... F04D 1/12; F04D 29/4293

See application file for complete search history.

(56) References Cited

U.S. PATENT DOCUMENTS

| | | | |
|---|---|---|---|
| 2,376,071 | A | 5/1945 | Miess |
| 3,004,495 | A | 10/1961 | Macklis |
| 3,384,024 | A | 5/1968 | King |
| 3,776,658 | A | 12/1973 | Erickson |
| 3,791,757 | A | 2/1974 | Tarifa et al. |
| 3,795,457 | A | 3/1974 | Erickson et al. |
| 3,795,459 | A | 3/1974 | Erickson et al. |
| 3,817,446 | A | 6/1974 | Erickson et al. |
| 3,822,102 | A | 7/1974 | Erickson et al. |
| 3,838,939 | A | 10/1974 | Erickson et al. |
| 3,977,810 | A | 8/1976 | Erickson et al. |
| 3,994,618 | A | 11/1976 | Erickson |
| 3,999,881 | A | 12/1976 | Crichlow |
| 4,036,427 | A | 7/1977 | Erickson et al. |
| 4,045,145 | A | 8/1977 | Erickson et al. |
| 4,073,596 | A | 2/1978 | Erickson et al. |
| 4,161,448 | A | 7/1979 | Erickson et al. |

(Continued)

FOREIGN PATENT DOCUMENTS

| | | | |
|---|---|---|---|
| CA | 2241508 | A1 | 2/1999 |
| CN | 201916204 | U | 8/2011 |

(Continued)

OTHER PUBLICATIONS

SU1373876 English translation.*

*Primary Examiner* — Ninh H Nguyen
*Assistant Examiner* — Brian O Peters
(74) *Attorney, Agent, or Firm* — Morriss O'Bryant Compagni

(57) ABSTRACT

A centrifugal pump of the pitot type is structured with axially-arranged inlet and discharge features positioned on opposing axial sides of a rotor, the rotor being journalled between a rotating sleeve and a suction inlet, and the rotating sleeve being concentric with the discharge, the rotating sleeve being gear-driven by a drive mechanism.

18 Claims, 4 Drawing Sheets

(56) References Cited

U.S. PATENT DOCUMENTS

| | | | |
|---|---|---|---|
| 4,183,713 | A | 1/1980 | Erickson et al. |
| 4,230,564 | A | 10/1980 | Keefer |
| 4,252,499 | A | 2/1981 | Erickson |
| 4,264,269 | A | 4/1981 | Erickson et al. |
| 4,267,964 | A | 5/1981 | Williams |
| 4,279,571 | A | 7/1981 | Erickson |
| 4,280,790 | A | 7/1981 | Crichlow |
| 4,281,962 | A | 8/1981 | Erickson |
| 4,283,005 | A | 8/1981 | Erickson |
| 4,355,951 | A | 10/1982 | Grose |
| 4,674,950 | A | 6/1987 | Erickson |
| 4,679,980 | A | 7/1987 | Bland |
| 4,875,826 | A | 10/1989 | Readman |
| 5,098,255 | A | 3/1992 | Weber |
| 5,135,353 | A | 8/1992 | Westhoff et al. |
| 5,145,314 | A | 9/1992 | Westhoff, Jr. et al. |
| 5,261,784 | A | 11/1993 | Weber |
| 6,325,594 | B1 | 12/2001 | Johnson et al. |
| 6,364,059 | B1 | 4/2002 | Wellton Persson |
| 7,824,149 | B2 | 11/2010 | Brewer |
| 8,403,625 | B2 | 3/2013 | Binder et al. |
| 2005/0112007 | A1 | 5/2005 | Demers et al. |
| 2011/0097190 | A1* | 4/2011 | Bertels ..... F04D 29/2222 415/89 |
| 2012/0107093 | A1 | 5/2012 | Binder et al. |

FOREIGN PATENT DOCUMENTS

| | | | |
|---|---|---|---|
| CN | 202468201 | U | 10/2012 |
| DE | 888048 | * | 7/1953 |
| DE | 2443788 | A1 | 3/1979 |
| DE | 102007033644 | A1 | 1/2009 |
| DE | 102011050658 | A1 | 11/2012 |
| EP | 0013038 | A1 | 7/1980 |
| GB | 852653 | A | 10/1960 |
| GB | 1388563 | A | 3/1975 |
| GB | 1433283 | A | 4/1976 |
| GB | 1440301 | A | 6/1976 |
| GB | 1440533 | A | 6/1976 |
| GB | 1469885 | A | 4/1977 |
| GB | 1515955 | A | 6/1978 |
| GB | 1535642 | A | 12/1978 |
| GB | 2045351 | A | 10/1980 |
| JP | 35655799 | U | 5/1981 |
| JP | 62113885 | A | 5/1987 |
| RU | 2309296 | C1 | 10/2007 |
| SU | 652351 | A1 | 3/1979 |
| SU | 1373876 | A1 | 2/1988 |
| WO | 8912170 | A1 | 12/1989 |
| WO | 9215787 | A1 | 9/1992 |
| WO | 9504226 | A1 | 2/1995 |
| WO | 9922144 | A1 | 5/1999 |
| WO | 03089788 | A1 | 10/2003 |
| WO | 06096448 | A2 | 9/2006 |

* cited by examiner

GEAR-DRIVEN FLOW-THROUGH PITOT TUBE PUMP

CROSS-REFERENCE TO RELATED APPLICATION

This is a non-provisional application which claims priority to U.S. provisional application Ser. No. 61/798,539, filed Mar. 15, 2013, the contents of which are incorporated herein in full.

TECHNICAL FIELD

This disclosure relates in general to centrifugal pumps and, in particular, to an improved centrifugal pump of the pitot type having a flow-through, gear-driven configuration.

BACKGROUND OF THE DISCLOSURE

Centrifugal pumps are well known and widely used in a variety of industries to pump fluids or liquid/solid components of fluid mixtures. Centrifugal pumps, particularly those of the pitot type, generally comprise a pump housing having an inlet and an outlet and a rotor assembly which rotates within the pump housing by means of a drive unit. The fluid inlet and the fluid discharge in conventional pitot pumps are positioned in parallel orientation on the same side of the pump housing, in a side-by-side arrangement. Oftentimes, the inlet is concentric with the fluid discharge.

Fluid is directed through the pump inlet into the rotor chamber and as the rotor assembly rotates, the fluid is directed toward the inner peripheral surface of the rotor chamber as a result of centrifugal forces. The fluid is intercepted by a stationary pitot tube and fluid moves through the inlet of the pitot tube and through the pitot tube arm toward the discharge outlet of the pump.

Typical centrifugal pumps of the pitot tube type are disclosed in U.S. Pat. No. 3,822,102 to Erickson, et al.; U.S. Pat. No. 3,960,319 to Brown, et al.; U.S. Pat. No. 4,161,448 to Erickson, et al.; U.S. Pat. No. 4,280,790 to Crichlow; U.S. Pat. No. 4,332,521 to Erickson and U.S. Pat. No. 4,674,950 to Erickson. In the pumps disclosed in the referenced patents, the fluid inlet and discharge outlet are positioned on the same side of the pump casing. The inlet of the rotor surrounds the entry point of the pitot tube into the interior of the rotor. Pitot tube pumps of this conventional construction can experience various disadvantages, including limitations on pump sizing and design to maximize pump efficiencies, poor or inefficient balancing of the very heavy rotor, bearing load designs that compromise the ability to resist the moment of an overhung rotor and seal leakage issues. As a result of these limitations, pump efficiencies can be compromised and the life of the pump can be shortened.

Other types of centrifugal pumps of the pitot type are disclosed in U.S. Pat. No. 3,791,757 to Tarifa, et al.; U.S. Pat. No. 4,875,826 to Readman; U.S. Pat. No. 2,376,071 to Miess and U.S. Pat. No. 3,384,024 to King. These patents disclose varying designs of pumps that employ one or more pitot tubes in a rotor. They disclose varying configurations for directing fluid into the rotor and discharging fluid from the rotor, typically in parallel directions on a single side of the pump, or they disclose ingress and egress of fluid at perpendicular angles to each other. U.S. Pat. No. 3,791,757 to Tarifa, et al. and U.S. Pat. No. 4,875,826 to Readman also disclose pump configurations where fluid enters a rotor from one direction of the rotor and exits from an opposing side of the rotor. However, these designs, due to the configuration of the pumps, result in high or significantly ineffective NPSH (net positive suction head). They are also configured such that some of the pumps lack effective hydraulic axial thrust balance, and many of the pumps are unable to operate at high speeds or adequate pressures. These prior known pumps can also be very complex and, therefore, costly to build and maintain, while also resulting in poor pump performance.

SUMMARY

In a first aspect of the disclosure, a pump assembly comprises a rotating assembly having a rotor and a rotating sleeve, a stationary pitot tube assembly having at least one pitot tube positioned within said rotor, a fluid inlet positioned to deliver fluid to said rotor along a defined axis and a fluid discharge axially arranged with the defined axis of said fluid inlet and being axially spaced from said fluid inlet, wherein said rotor is journalled between said rotating sleeve and said axially spaced fluid inlet. This aspect of the disclosure has particular advantages over conventional pitot type pumps in enabling the ability to provide a rotor inlet of increased area, compared to conventional pitot tube pumps, without the need to increase the size of the seal. The configuration, therefore, reduces velocity characteristics in the pump inlet, which improves NPSH (net positive suction head). Because the pump configuration enables an increased rotor inlet dimension without increasing the seal size, the pump is capable of operating at more advantageous speeds and at higher suction pressures. The pump is also less expensive to manufacture since increased seal sizes increase production costs.

In some embodiments, the pump assembly is configured wherein the rotating sleeve is concentrically positioned about the fluid discharge.

In other certain embodiments, the pump assembly is configured wherein the fluid discharge comprises a portion of the stationary pitot tube assembly.

In yet another embodiment, the fluid inlet of the pump assembly further comprises a suction shaft that rotates as part of the rotating assembly.

In still another embodiment, the rotor is comprised of a rotor bottom connected to a rotor cover forming a rotor chamber therebetween within which at least one pitot tube is positioned.

In yet other embodiments, the rotor cover is configured with enclosed vanes providing enclosed, channeled ingress of fluid into the rotor chamber.

In some embodiments, the pump assembly further comprises a drive mechanism connected to the rotating sleeve.

In another embodiment, the drive mechanism, at least in part, is positioned to encircle the discharge outlet.

In still other embodiments, the pump assembly further comprises a pump housing having a seal housing portion and a rotor housing portion and the pump assembly further comprises a suction shaft defining the fluid inlet, wherein the suction shaft extends through the seal housing portion of the pump housing, the seal housing portion being arranged to provide an air gap in contact with a seal mechanism positioned in the seal housing.

In other embodiments, the pump assembly further comprises a drive housing portion of the pump housing that is configured to receive a drive mechanism in contact with the rotating sleeve.

In still other embodiments, the discharge outlet extends through the drive housing portion and further extends through a discharge housing portion of the pump housing.

In yet other embodiments, the pump assembly further comprises an inducer positioned at the fluid inlet.

In a second aspect of the disclosure, a centrifugal pump comprises a pump housing having a rotor housing portion, a rotor disposed within the rotor housing portion, the rotor having axially opposed sides defined by a rotor bottom positioned on one side and a rotor cover positioned on the axially opposing side thereto, the rotor bottom and rotor cover being secured together to form a closed chamber within the rotor, at least one pitot tube positioned within the closed chamber and a rotating sleeve connected to and extending away from one side of the rotor, the rotating sleeve being connected to a drive mechanism, and a fluid inlet extending from one side of the rotor, the fluid inlet being positioned to deliver fluid to the rotor cover for directing fluid to the closed chamber, and a fluid discharge extending from the axially opposing side of the rotor, wherein the fluid inlet and the fluid discharge each have a central axis, and the central axes are axially arranged relative to each other. The centrifugal pump of this aspect provides advantages over conventional centrifugal pumps in having the ability to provide a rotor or fluid inlet of increased area, compared to conventional pitot tube pumps, without the need to increase the size of the seal. The configuration, therefore, reduces velocity characteristics in the pump inlet, which improves NPSH (net positive suction head). Because the pump configuration enables an increased rotor of fluid inlet without increasing the seal size, the pump is capable of operating at more advantageous speeds and at higher suction pressures. The pump is also less expensive to manufacture. The configurations of the centrifugal pump of the disclosure have the further advantage of eliminating leakage of fluid from the rotor chamber at the inlet into the rotor. That is, in conventional pitot tube pumps, the point at which the pitot tube is positioned or enters into the rotor also comprises the inlet to the rotor, and in conventional pitot tube configurations, some fluid is allowed to leak from the interior of the rotor back to the rotor inlet. The leaked fluid, coming from higher temperature and pressure, vaporizes, blocking the rotor cover inlet, especially in low NPSH applications, in the lower pressure at the inlet of the rotor. The leakage also increases the flow volume into the entrance to the rotor, thereby increasing the velocity and decreasing the NPSH performance. The centrifugal pump of this aspect of the disclosure has the additional advantage in having improved hydraulic axial, or thrust, force balance as a result of opposing openings in the rotor to accommodate the fluid inlet on one side and the entry point of the pitot tube on the other side. The configuration, therefore, provides improved bearing life and allows the pump to tolerate higher suction pressures.

In some embodiments, the fluid discharge is stationary and is connected to at least one pitot tube.

In other embodiments, the fluid inlet further includes a suction shaft connected to the rotor cover.

In yet other embodiments, the suction shaft rotates with said rotor.

In still other embodiments, the pump housing further comprises a seal housing, and the suction shaft extends from one side of the rotor through the seal housing, the seal housing providing an air gap about the suction shaft and in contact with a seal mechanism positioned in a space formed in the seal housing, preventing fluid from entering the drive housing in the event of seal failure.

In certain embodiments, the fluid discharge extends from the rotor through a discharge housing formed in the pump housing.

In still other embodiments, the centrifugal pump further comprises a seal mechanism positioned between the rotating sleeve and the discharge housing of the pump housing.

In yet other embodiments, the drive mechanism is a driven gear arrangement.

In certain other embodiments, the centrifugal pump further comprises an inducer positioned at said fluid inlet.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
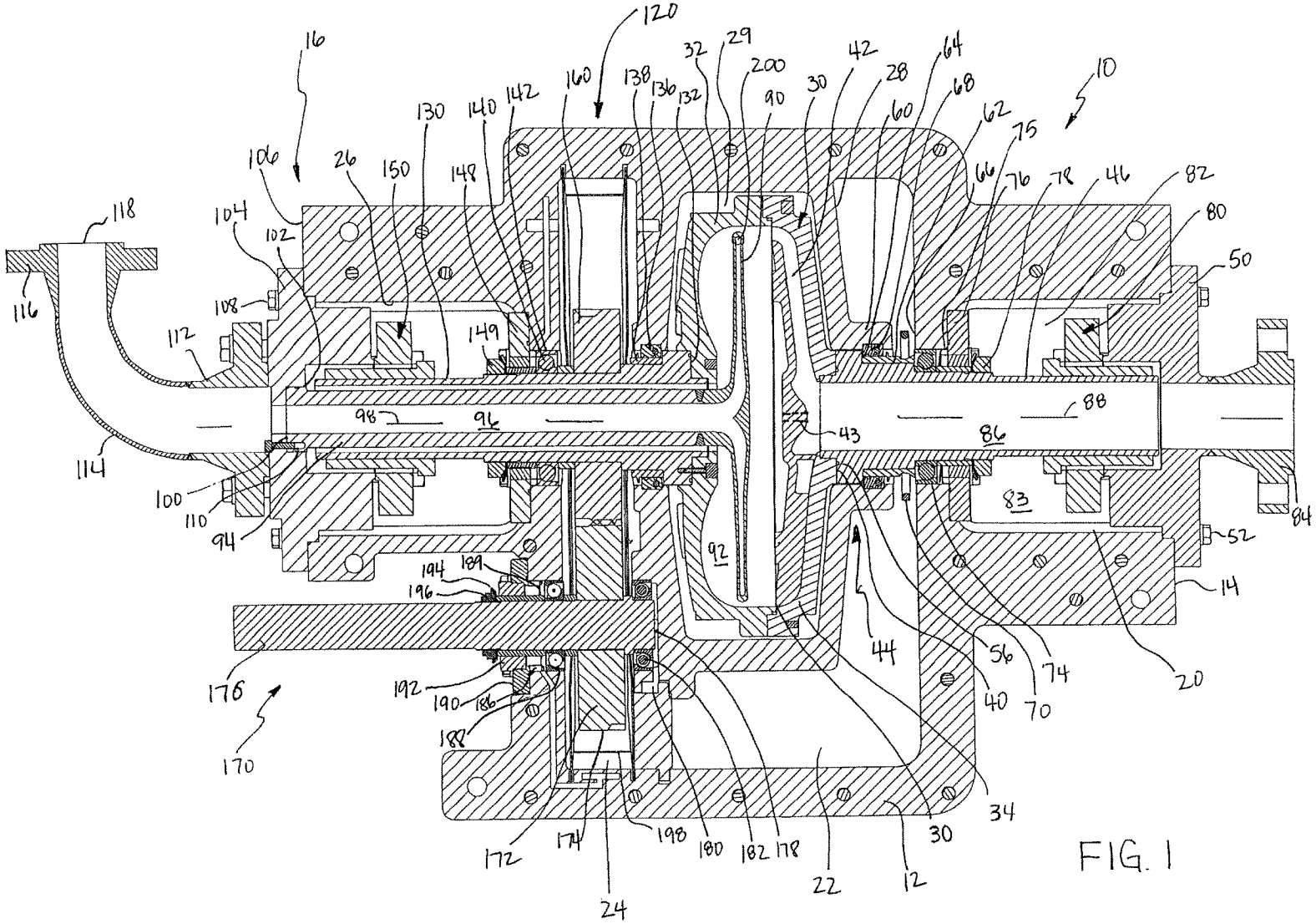
FIG. 1 is a view in longitudinal cross section of a first embodiment of a pump in accordance with this disclosure.
Figure 2:
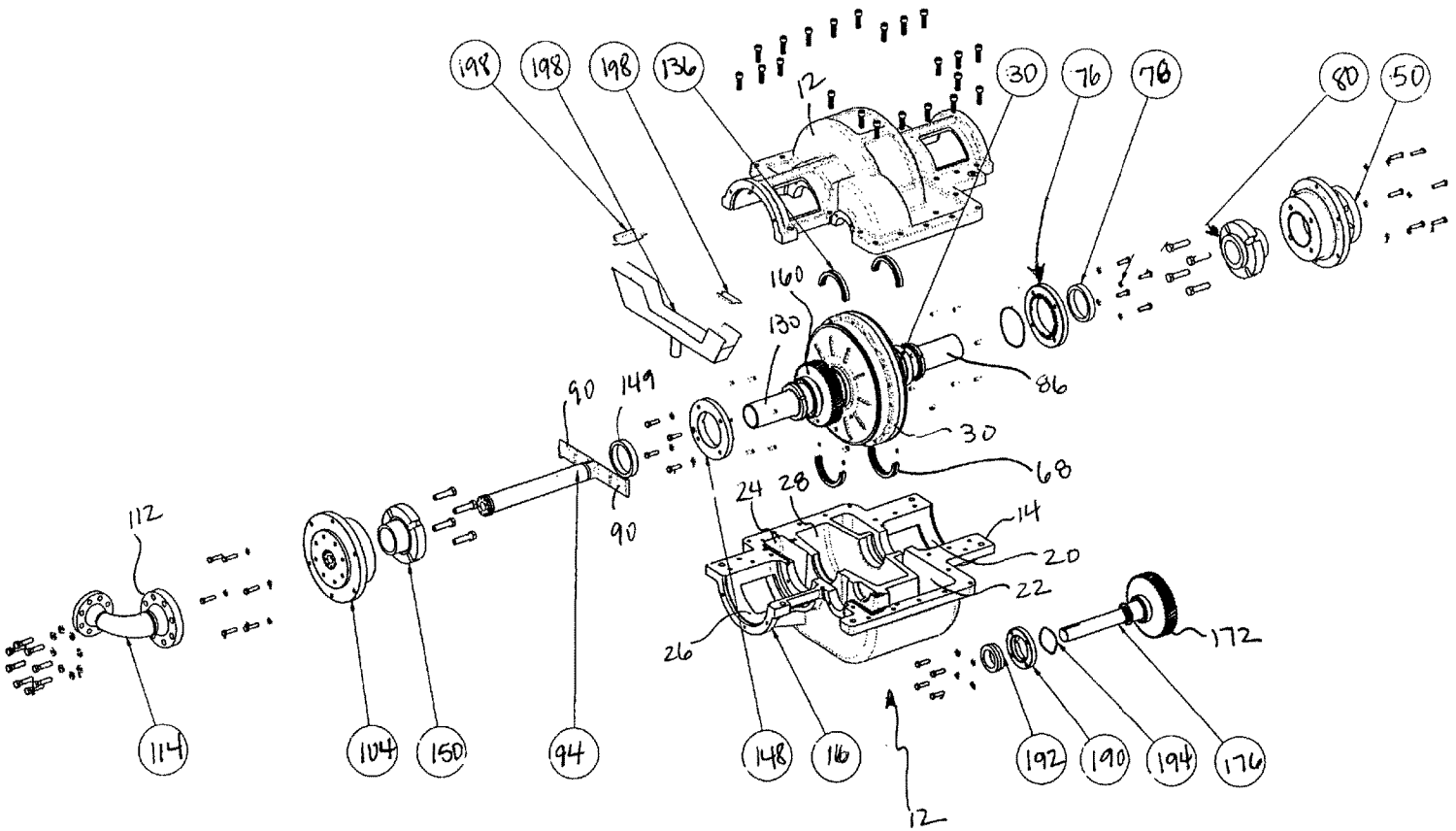
FIG. 2 is an exploded view of the pump shown in FIG. 1.

FIGS. 1 and 2 illustrate a first embodiment of a pitot tube assembly and pump 10 in accordance with the present disclosure. The pump 10 comprises a pump casing or pump housing 12 having a first end 14 and a second end 16, the two ends being in axially opposed orientation to each other. The pump housing 12 may be configured with a suction seal housing portion 20, a gear frame portion 22, a drive housing portion 24, a discharge housing portion 26 and a rotor housing portion 28.

The pump 10 is further comprised of a rotor 30 that is positioned in the rotor housing portion 28. The rotor housing portion 28 may be structured with a cavity 29 in which the rotor 30 is disposed. The rotor 30 has axially opposed sides that, in some embodiments, may be defined by a rotor bottom 32, comprising one side, and a rotor cover 34, comprising the opposing side that is axially spaced or axially positioned relative to the other side of the rotor 30. The rotor bottom 32 and rotor cover 34 are secured together.

The rotor cover 34 has a central opening that defines a rotor inlet 40 through which fluid enters the rotor 30. In some embodiments, the rotor cover 34 may have enclosed vanes 42 formed in the interior of the rotor cover 34. The enclosed vanes 42 may generally be radially oriented and aid in channeling or directing fluid that is entering into the rotor 30 via the rotor inlet 40 toward the peripheral inner surface of the rotor 30. In some embodiments, it may be advantageous to configure the rotor cover 34 with a vent 43, shown in FIG. 1 in phantom line, to allow any air trapped within the rotor to escape.

The pump 10 includes a fluid inlet arrangement 44 for directing fluid into the rotor 30 for pumping. The fluid inlet arrangement 44 includes a suction shaft 46 that extends from the rotor inlet 40, through the suction seal housing portion 20, to a gland end cap 50 that is attached to the first end 14 of the pump housing 12 by means such as bolts 52. The suction shaft 46 registers against the rotor inlet 40 of the rotor 30 and is sealed against the rotor cover 34 by an 0-ring 56. The suction shaft 46 extends through an axially extending portion 60 of the rotor housing portion 28. A shaft sleeve 62 encircles the suction shaft 46, extending from an inwardly extending shoulder 64 of the shaft sleeve 46 to an inner wall 66 of the gear frame portion 22. A labyrinth seal 68 is positioned between the shaft sleeve 62 and the axially extending portion 60, and an oil ring 70 is positioned against the labyrinth seal 68, thereby sealing the rotor housing portion 28 from the gear frame portion 22.

The suction shaft 46 is supported by a suction shaft bearing 74 that is positioned in an opening 75 between the suction seal housing portion 20 and the gear frame housing portion 22. A bearing isolator plate 76 is positioned against the suction shaft bearing 74 and is secured in place by a securement ring 78.

Spaced from the bearing isolator plate 76 is a suction seal arrangement 80 that registers against the gland end cap 50 and seals the suction seal housing portion 20 of the pump housing. Further, the construction of the suction seal housing portion 20 with a space 83 therein, and the suction seal arrangement 90 disposed in the space 83, provides an advantageous air gap 82 that assures, in the event of a catastrophic failure of the seal arrangement 80, that pumping fluid does not infiltrate into the gear frame portion 22 of the pump casing 12. The seal arrangements in conventional pitot tube pumps are situated in a manner that frequently leads to damage of the components within the pump casing when a catastrophic seal failure occurs.

A flanged inlet end 84 is secured to or formed with the gland end cap 50, and provides the point of ingress of fluid into the suction shaft 46, which defines a fluid inlet 86 having a central axis 88.

A stationary pitot tube 90 is positioned in the rotor chamber 92 of the rotor 30. The stationary pitot tube 90 shown in FIG. 1 has a dual inlet configuration; however, a single inlet pitot tube may also be used in the pump. The pitot tube 90 is connected to or formed with a discharge tube 94 that defines a fluid discharge 96 having a central axis 98. The pitot tube 90 and fluid discharge 96 comprise a pitot tube assembly. In a particularly suitable embodiment, the central axis 98 of the fluid discharge 96 is axially aligned with and co-axially arranged relative to the central axis 88 of the fluid inlet 86. In other embodiments, the central axis 98 of the fluid discharge 96 may be axially aligned with the central axis 88 of the fluid inlet 86.

The end 100 of the discharge tube 94 that is distanced from the pitot tube 90 is received in an opening 102 in a discharge end gland plate 104 that is secured to the end 106 of the discharge housing portion 26 by such means as bolts 108. An o-ring 110 is positioned between the end 100 of the discharge tube 94 and the discharge end gland plate 104 to provide a seal therebetween. Additional discharge piping may be provided to direct discharge fluid from the discharge tube 94 to downstream processing, the piping including, for example, a flanged end member 112 having a discharge elbow 114 and a flanged discharge outlet pipe 116 defining an ultimate discharge outlet 118. By virtue of the connection of the discharge tube 94 to the discharge end gland plate 104, the pitot tube 90 is stationary.

A drive mechanism 120 is attached to the rotor 30 to provide rotation of the rotor 30. The drive mechanism 120 as shown in FIG. 1 includes a rotating sleeve 130 that is secured at one end 132 to the rotor bottom 32, defining one axial side of the rotor 30. The rotating sleeve 130 is tubular in configuration and is sized to receive the discharge tube 94 therethrough in a concentric arrangement therewith while allowing the rotating sleeve 130 to rotate freely about the stationary discharge tube 94.

A labyrinth seal 136 is positioned between an opening in the rotor housing portion 28, through which the rotating sleeve 130 and discharge tube 94 extend, and seal ring 138 that surrounds the rotating sleeve 130 to seal the rotor housing portion 28 from the drive housing portion 24. A bearing 140 is positioned in an opening 142 formed between the drive housing portion 24 and the discharge housing portion 26 of the pump casing 12, and is held in place by a bearing isolator plate 148 that is positioned in the discharge housing portion 26 and locked in place by a locking nut 149.

The rotor 30 is journalled by and between the rotating sleeve 130, on one side of the rotor 30, and the fluid inlet 86, on the other, axially opposing side of the rotor 30. Thus, the rotor 30 is effectively supported by the bearing 68 in the rotor housing portion 28 and the bearing 140 located between the rotor housing portion 28 and the discharge housing portion 26. The position of the two bearings, 68, 140 advantageously provides improved axial or thrust force balance for the rotor 30, which is very heavy. The balancing of the rotor 30 achieved by the configuration of the present disclosure provides a significant advantage over conventional cantilevered pitot tube arrangements in providing better stability, enhanced smoothness of operation and enhanced operational speeds.

A seal arrangement 150 surrounds the other end 152 of the rotating sleeve 130. The seal arrangement 150 is received in the discharge end gland plate 104, and centrally positions the rotating sleeve 130 relative to the discharge end gland plate 104, as well as providing a seal therebetween.

The drive mechanism further comprises a first gear disk 160 that is positioned about and secured to the rotating sleeve 130, and is positioned in the drive housing portion 24 of the pump casing 12. The outer surface of the first gear disk 160 is structured with teeth or similar devices in known fashion. A drive element 170 is provided to effect rotation of the first gear disk 160, and consequently the rotor 30 by way of the rotating sleeve 130. As illustrated, the drive element 170 may include a second gear disk 172 that is registered against the first gear disk 160, and is positioned within the drive housing portion 24 of the pump casing 12. The second gear disk 172 has an outer surface 174 that is configured with teeth or similar devices that interface with the teeth or similar devices on the first gear disk 170 to thereby impart rotation to the first gear disk 160.

The second gear disk 172 is attached to a drive shaft 176 that is connected to a motor (not shown) which imparts rotation to the drive shaft 176 in known fashion. A first end 178 of the drive shaft 176 is carried in a space 180 provided in the pump casing or housing 12, such as in the rotor housing portion 28. A bearing 182 ring is positioned to support the first end 178 of the drive shaft 176. The drive shaft 176 is also positioned through the pump casing 12 via an opening 186 formed in the drive housing portion 24.

The drive shaft 176 is centrally positioned and supported in the opening 186 by a second bearing 188. The second bearing 188 is secured within the opening 186 by means of a wave spring 189 and a drive end plate 190. A drive shaft seal 192 is positioned against the drive end plate 190 and is held in place with a washer 194 and a locking nut 196. An oil pan 198 may be positioned in the drive housing portion 24 to lubricate the gear disks or to receive excess lubrication fluid. While drive gears are illustrated herein, other types of drives, including a bevel gear arrangement, may be employed.

In operation, fluid enters into the suction shaft 46 via the flanged inlet end 84 and is directed through the fluid inlet 86 into the inlet 60 of the rotor 30. Fluid entering the rotor cover 34 encounters the enclosed vanes 42 of the rotor cover 34, which accelerate the fluid and direct the fluid to the inner peripheral wall of the rotor 30, where the fluid encounters the inlet(s) 200 of the stationary pitot tube 90. The fluid enters into the pitot tube 90 and is directed into the fluid discharge 96 for delivery to the discharge outlet 118. Consequently, with this arrangement, fluid enters the rotor 30 on one side of the rotor 30 and exits or discharges on an opposing side of the rotor 30 that is axially spaced from the fluid inlet 86.

The pump of the present disclosure provides a fluid inlet 86 and a fluid discharge 96 that are axially positioned at opposing ends 14, 16 of the pump casing 12. In a particularly suitable arrangement, the central axis 88 of fluid inlet 86 is co-axial with the central axis 98 of the fluid discharge 96. This arrangement provides several advantages as discussed supra. In a further suitable arrangement of the disclosure, the drive mechanism may be associated with a rotating sleeve that is concentrically formed about the fluid inlet 86, rather than a drive mechanism being arranged as shown in FIG. 1. Other suitable arrangements are within the scope of the disclosure.

Figure 3:
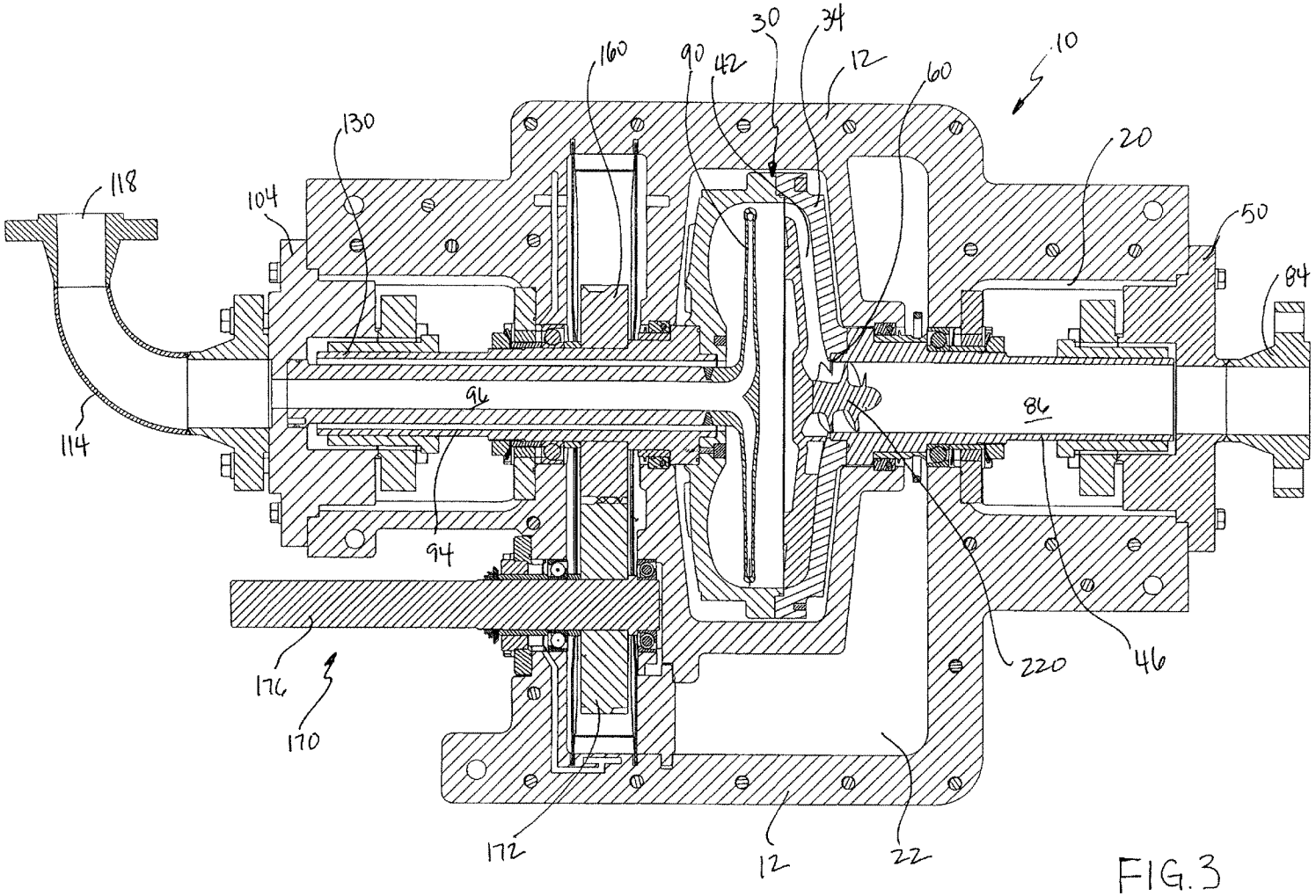
FIG. 3 is a view in longitudinal cross section of a second embodiment of a pump in accordance with the present disclosure.

In a further arrangement of the present disclosure shown in FIG. 3, which is substantially similar to the embodiment shown in FIG. 1 and bears the same reference numerals therefore, the pump of the disclosure may include an inducer 220 that is positioned at the rotor inlet 40 of the rotor 30. Notably, part of the rotor cover 34 is removed from the illustration for the purpose of better depicting the inducer 220 more clearly. The inducer 220 increases pressure at the rotor inlet 40, thereby reducing cavitation at the inlet of the rotor cover 34. The inducer 220 may be any suitable configuration that facilitates the flow direction of fluid moving into and through the rotor inlet 40. The inducer 220 is beneficial in increasing the NPSH performance of the pump, but may not be required or desirable in all applications.

Figure 4:
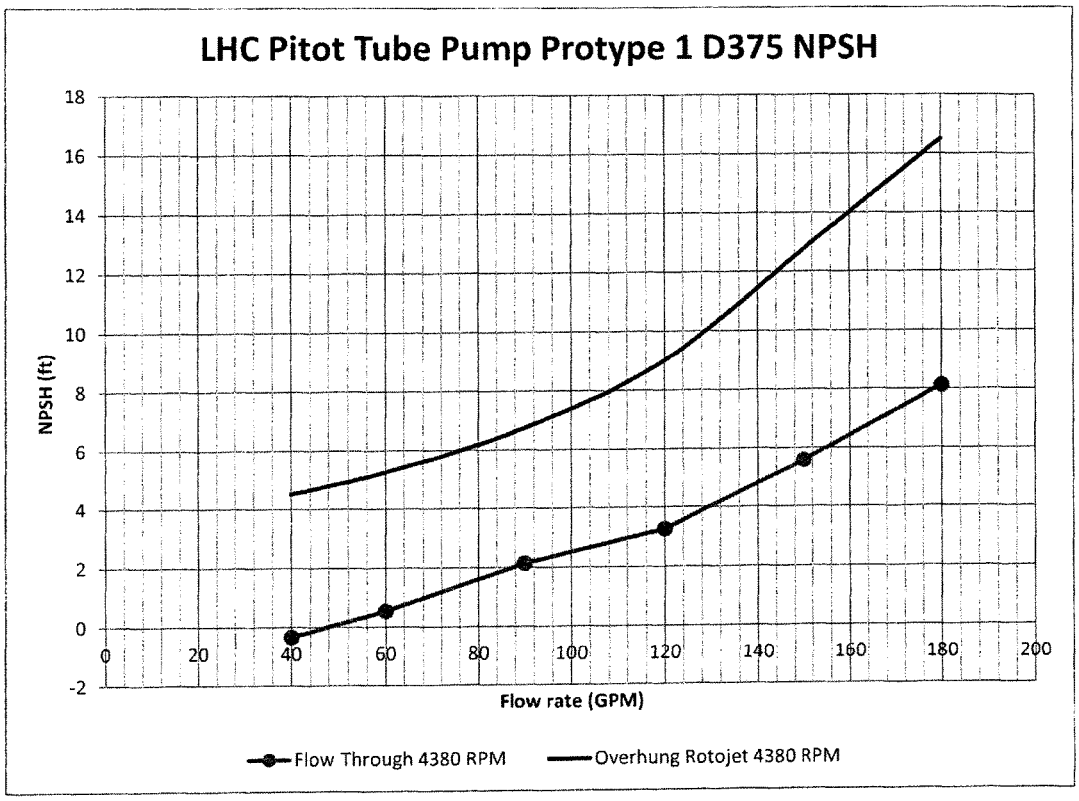
FIG. 4 is a graph illustrating the improved operation of a pump in accordance with the present disclosure in comparison with a conventional pitot tube pump.

A centrifugal pump that is constructed in the manner described herein provides significant advantages over centrifugal pitot tube pumps of the conventional variety where the suction inlet and fluid discharge are positioned on the same side of the rotor. The graph of FIG. 4 illustrates test results of performance comparisons between a pump constructed in accordance with the present disclosure and a centrifugal pitot pump configured with a fluid inlet that enters on one side of the rotor, the fluid inlet concentrically surrounding a fluid discharge in the form of a pitot tube arm positioned on the same side of the rotor (i.e., "prior known pump"). Net Positive Suction Head (NPSH) is the net positive pressure above the vapor pressure of the working fluid at the pump inlet required for the pump to operate. Lower NPSH allows the pump to operate on systems with lower tank and or sump elevations and at lower pressures, reducing the overall cost of fluid system operation. The test results indicate that the prior known pump has a higher NPSH profile (upper smooth line in the graph) than a pump constructed in accordance with the present disclosure (lower dotted line in the graph). The improved, or lower, NPSH profile of the pump of the present disclosure is consistently better in comparison to the prior known pump as flow rate, measured in gallons per minute (GPM), increases.

In the foregoing description of certain embodiments, specific terminology has been employed for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, inventions have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A pump assembly, comprising:

a rotating assembly having a rotor and a rotating sleeve positioned on one axial side of the rotor;

a stationary pitot tube assembly having at least one pitot tube positioned within said rotor;

a fluid inlet arrangement positioned to deliver fluid to said rotor along a defined axis, said fluid inlet arrangement including a suction shaft positioned on an axially opposed side of the rotor opposite the rotating sleeve and being axially spaced apart from said rotating sleeve;

a fluid discharge axially arranged with the defined axis of said fluid inlet and being axially spaced from said fluid inlet;

a drive mechanism connected to the rotating assembly to provide co-rotation of both said suction shaft and said rotating sleeve with rotation of said rotor;

a suction seal housing portion through which said suction shaft extends, the suction seal housing portion being arranged to provide an air gap in contact with a seal mechanism positioned in said suction seal housing portion; and a bearing positioned about said suction shaft and an isolator plate positioned against said bearing, said isolator plate being held in position against the suction seal housing portion with a securement ring oriented toward said air gap and spaced from said seal mechanism positioned in said suction seal housing to isolate said bearing from said air gap, wherein said rotor is journalled by and between said rotating sleeve on one axial side of the rotor and said axially spaced suction shaft on the axially opposed side of the rotor.

2. The pump assembly of claim 1, wherein said rotating sleeve is concentrically positioned about said fluid discharge.

3. The pump assembly of claim 1, wherein said fluid discharge comprises a portion of said stationary pitot tube assembly.

4. The pump assembly of claim 1, wherein said rotor is comprised of a rotor bottom connected to a rotor cover forming a rotor chamber therebetween within which said at least one pitot tube is positioned.

5. The pump assembly of claim 4, wherein the rotor cover is configured with enclosed vanes providing channeled ingress of fluid into said rotor chamber.

6. The pump assembly of claim 1, wherein said drive mechanism is connected to said rotating sleeve.

7. The pump assembly of claim 6, wherein said drive mechanism, at least in part, is positioned to encircle said discharge outlet.

8. The pump assembly of claim 1, further comprising a drive housing portion configured to receive the drive mechanism in contact with said rotating sleeve.

9. The pump assembly of claim 8, wherein said fluid discharge extends through said drive housing portion and further extends through a discharge housing portion of the pump housing.

10. The pump assembly of claim 1, further comprising an inducer positioned at said fluid inlet.

11. A centrifugal pump, comprising;

a pump housing having a rotor housing portion for fully enclosing a rotor;

a rotor disposed within said rotor housing portion, said rotor having axially opposed sides defined by a rotor bottom positioned on one side and a rotor cover positioned on the axially opposing side, said rotor bottom and rotor cover being secured together to form a closed chamber within said rotor;

at least one pitot tube positioned within said closed chamber;

a rotating sleeve connected to and extending away from one axial side of said rotor, said rotating sleeve being connected to a drive mechanism;

a fluid inlet including a suction shaft connected to and extending from an opposing axial side of said rotor, said fluid inlet being positioned to deliver fluid to said rotor cover for directing fluid to said closed chamber;

a fluid discharge extending from said axially opposing side of said rotor;

a suction seal housing portion through which said suction shaft extends, the suction seal housing portion being arranged to provide an air gap in contact with a seal mechanism positioned in said suction seal housing portion; and a bearing positioned about said suction shaft and an isolator plate positioned against said bearing, said isolator plate being held in position against the suction seal housing portion with a securement ring oriented toward said air gap and spaced from said seal mechanism positioned in said suction seal housing to isolate said bearing from said air gap, wherein said rotor is journalled by and between said rotating sleeve on one axial side of the rotor and said suction shaft on the axially opposed side of the rotor, the fluid inlet being axially spaced from the rotating sleeve, and wherein said fluid inlet and said fluid discharge each have a central axis, and said central axes are axially arranged.

12. The centrifugal pump of claim 11, wherein said fluid discharge is stationary and connected to said at least one pitot tube.

13. The centrifugal pump of claim 12, wherein said suction shaft is connected to said rotor cover.

14. The centrifugal pump of claim 13, wherein said suction shaft rotates with said rotor.

15. The centrifugal pump of claim 12, wherein said fluid discharge extends from said rotor through a discharge housing formed in said pump housing.

16. The centrifugal pump of claim 15, further comprising a seal mechanism positioned between said rotating sleeve and said discharge housing of said pump housing.

17. The centrifugal pump of claim 11, further comprising an inducer positioned at said fluid inlet.

18. A pump assembly, comprising:

a pump casing;

a rotating assembly positioned within the pump casing and having a rotor and a rotating sleeve;

a stationary pitot tube assembly having at least one pitot tube positioned within said rotor;

a fluid inlet having a suction shaft positioned to deliver fluid to said rotor along a defined axis, said fluid inlet being axially spaced apart from said rotating sleeve; and a fluid discharge axially arranged with the defined axis of said fluid inlet and being axially spaced from said fluid inlet;

a seal arrangement positioned to provide a seal between the rotating sleeve and the pump casing;

a drive mechanism, at least in part, positioned to encircle said fluid discharge, the drive mechanism being arranged between the rotating assembly and the seal arrangement and being positioned to provide co-rotation to both said suction shaft and said rotating sleeve and rotation of the rotor, a bearing positioned about said suction shaft with an isolator plate positioned about said suction shaft adjacent said bearing, said isolator plate being held in position with a securement ring oriented toward an air gap to isolate said bearing from said air gap, wherein said rotor is journalled by and between said rotating sleeve and said axially spaced fluid inlet.

* * * * *